United States Patent [19]

Nakagawa et al.

[11] 4,049,541

[45] Sept. 20, 1977

[54] PROCESS FOR CONTROLLING THE SIZE OF COKE PARTICLES WITHIN A FLUIDIZED BED

[75] Inventors: Tetsuo Nakagawa, Fujisawa; Nobuo Matsuda, Kawasaki; Kazumitsu Mitani, Tokyo; Toshiharu Tanemoto, Yokohama, all of Japan

[73] Assignees: Chiyoda Chemical Engineering & Construction Co. Ltd.; Mitsubishi Petrochemical Company Limited, both of Japan

[21] Appl. No.: 664,389

[22] Filed: Mar. 5, 1976

[30] Foreign Application Priority Data

Mar. 11, 1975 Japan ..... 50-28601

[51] Int. Cl.[2] ..... C10G 9/32

[52] U.S. Cl. ..... 208/127; 208/152

[58] Field of Search ..... 208/127, 152

[56] References Cited

U.S. PATENT DOCUMENTS

| | | | |
|---|---|---|---|
| 2,661,324 | 12/1953 | Leffer | 208/127 |
| 2,721,168 | 10/1955 | Kimberlin et al. | 208/127 |
| 2,734,852 | 2/1956 | Moser | 208/152 |
| 2,872,390 | 2/1959 | Schulman | 208/127 |
| 2,893,946 | 7/1959 | Brown | 208/127 |

*Primary Examiner*—Herbert Levine

*Attorney, Agent, or Firm*—Armstrong, Nikaido & Marmelstein

[57] ABSTRACT

A process for controlling the coke balance as well as the size of coke particles within a fluidized bed in the range adapted for continuous operation of a heavy residual oil cracking apparatus, wherein thermal cracking of heavy residual oil is performed under fluidization of coke particles and steam, which comprises classifying one portion of the coke particles withdrawn from the fluidized bed into coarse particles and fine particles by means of a pneumatic classifier, and after the size of said coarse particles have been reduced by combustion, returning them to the fluidized bed along with said fine particles.

4 Claims, 4 Drawing Figures

PROCESS FOR CONTROLLING THE SIZE OF COKE PARTICLES WITHIN A FLUIDIZED BED

BACKGROUND OF THE INVENTION

This invention relates to a process for controlling the coke balance (mass balance on coke) as well as the size of coke particles within a fluidized bed in the range adapted for a continuous operation of a heavy residual oil cracking apparatus, wherein thermal cracking of heavy residual hydrocarbons from petroleum or coal e.g., crude oil, topped crude oil, fuel oil residue, vacuum residue, tar sand oil, pitch, asphaltene, etc., (hereinafter referred to as heavy residual oil), is performed at high temperatures under fluidization of coke particles and steam, and wherein the coke balance is maintained positively, i.e., the amount of coke formed is larger than that of coke lost in the apparatus. More particularly this invention relates to a process for controlling the coke balance as well as the size of coke particles in the system, which comprises classifying one portion of the coke particles withdrawn from the fluidized bed into coarse particles and fine particles by means of a pneumatic classifier, and after the size of said coarse particles has been reduced by combustion, returning them to the fluidized bed along with said fine particles.

In a fluidized bed hydrocarbon thermal cracking apparatus using coke particles as a heat carrier, it is of great importance to control the coke balance in the system as well as the size of coke particles within the fluidized bed in the ranges adapted for operation, but it is considerably difficult to do so. This is because the major portion of the coke formed under cracking adheres on the surfaces of the coke particles within the fluidized bed and, at the same time the coke particles reduce their size by gasification, powdering, etc. within the fluidized bed. The coke balance is the system becomes positive when the amount of the above described adhering coke exceeds the amount of the coke lost by gasification, powdering, etc., whereas it becomes negative when the former falls short of the latter. In either case, it is usual practice to control the coke balance in such a direction that it may approach zero as constantly as possible by any means. As one of the means there has been proposed a method in which the coke balance is maintained by carrying out concurrently the control of the rate of deposition of the carbonaceous material adhering on the surfaces of coke particles and the control of the rate of gasification and combustion of the adhering coke (Japanese Patent Publication No. 6,502/1971). On the other hand, it is known that the coke particles become coarser and coarser with time in the fluidized bed. For this reason, unless the particles whose size has increased are selectively reduced in size, the size distribution of the coke particles within the fluidized bed would not be able to be constantly maintained in the range adpated for operation. However, procedures such as withdrawal from the system of the particles whose size has increased and additional supply of fine particles from outside of the system are not only considerably troublesome in operation but also uneconomical. Processes for controlling by mechanical treating the size of the coarse particles withdrawn from the system are known in Japanese Patent Publication No. 9,136,/1956, etc.

SUMMARY OF THE INVENTION

The process of this invention provides a process which not only solves the problems arising from the heat carrier particles becoming coarser in size and increasing in quantity as the thermal cracking reaction proceeds under the condition positive with respect to the coke balance in the thermal cracking of the so-called heavy residual oils from petroleum or coal such as crude oil, topped crude oil, heavy oil, reduced pressure residue, tar sand oil, pitch, asphaltene, etc., by burning selectively a portion of the coke, but also utilizes beneficially the heat of combustion generated as the heating source for the coke. When considering the material balance of the coke particles in a heavy residual oil thermal cracking reactor which usually employs coke as the heat carrier particles, generally, the heavier the raw material oil used, the higher the value of Conradson carbon residue. Hence more coke is formed by the thermal cracking, so that the coke balance becomes positive. When operation is continued in such a state, the amount of the coke formed as well as the size of the coke particles continuously increases, and accordingly the fluidizing state of the fluidized bed becomes remarkably uneven, causing marked fluctuation of the pressure in the reactor. Therefore, in the case where the reactor used is of the coke particle circulation type, the operation of the reactor very often develops severe trouble such as the hampered circulation of the coke particles, etc.

BRIEF DESCRIPTION OF THE DRAWINGS

The invention will be further described with reference to the attached drawings in which.

DESCRIPTION OF PREFERRED EMBODIMENTS

Figure 1:
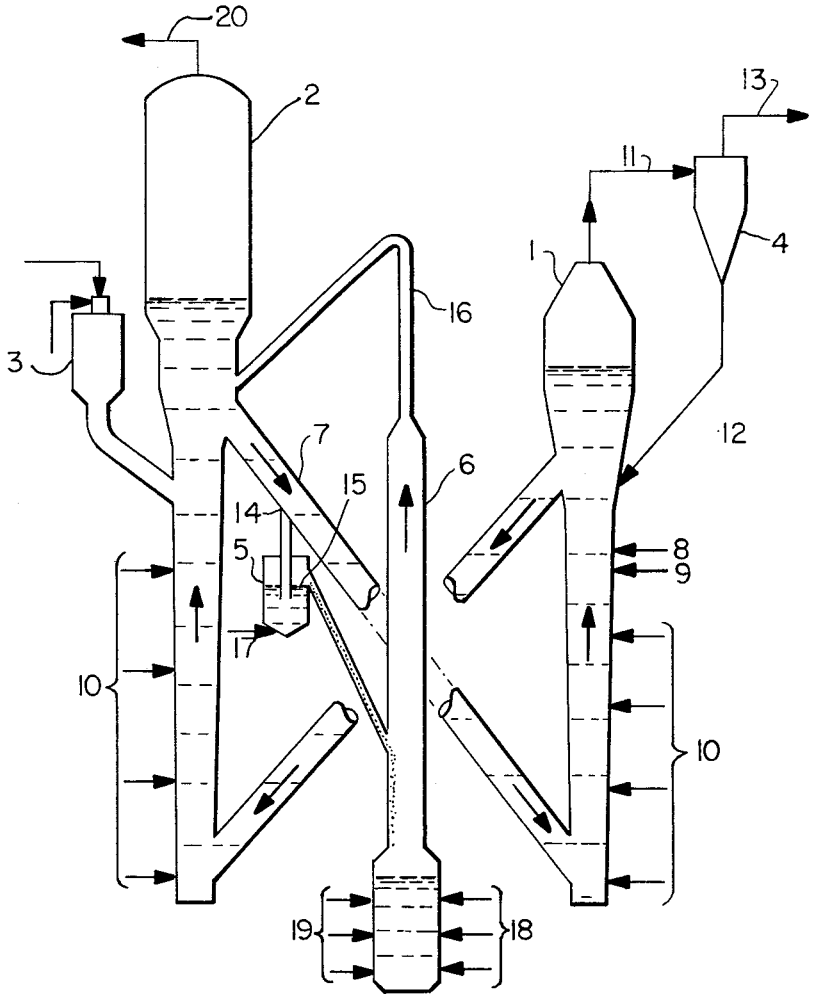
FIG. 1 is a process diagram illustrating one embodiment of this invention.

In accordance with the process of this invention, the heat carrier particles in a required amount are withdrawn from a position which does not directly affect the reaction, such as, for instance, an intermediate position between the heating zone and the reaction zone of said particles and are classified into two divisions of relatively fine particles and coarse particles by means of a pneumatic classifier. The coarse particles are burnt by contacting them with oxygen containing gas until their particle size becomes fine. Thereafter, these particles are returned to a position which does not directly affect the reaction such as, for instance, the upper portion of the heating zone of heat carrier particles, along with the above described fine particles, accompanying the high temperature flue contuining steam. Both the gas used in the pneumatic classifier and the gas used for the transporation of the classified fine particles and the particles reduced in size by burning are provided by the flue gas after the coarse particles have been burnt and superheated steam, which is desirable from the viewpoint of compactness of equipment and efficient utilization of heat. The reason why a pneumatic classifier is particularly used in this invention is that besides its case of control, it makes possible the combining of the combustion of coarse particles and the transportation of the size-reduced particles after said combustion treatment with the classified fine particles.

As the gas used for the combustion of coarse particles because it is oxygen containing gases can be used; air being most preferable, economically advantageous and easy in handling.

The amount of the gas used is adjusted according to the amount of the carbon to be burnt. And, as described above, the flue gas formed by the combustion of the coarse particles can be used along with superheated steam for the transportation of the size-reduced particles and the classified fine particles, so that in this case the amount of the gas is controlled in such a manner that the gas is almost free from oxygen so as not to burn the fine particles.

The withdrawal of coke particles is carried out continuously at a position which does not particularly affect the thermal cracking and the coke heating in each separated zone. In this regard, the position close to the heating zone in the transport pipe from the heating zone to the reaction zone is most suitable, because of the advantages that the movement of the coke particles at that position is so smooth that the withdrawal is suitably feasible, and because the temperature at that position is high and is better on the heat balance in the system. The adjustment of the amount of coke particles to be withdrawn can be achieved by adjusting the amount of coke particles to be fed to the pneumatic classifier. The amount can be adjusted by forming a fluidized state in a storage vessel which has been provided, for instance, beneath the withdrawal port, by means of controlled gas stream into the storage vessel. As this invention does not use any mechanical means for withdrawal, even when the amount of the coke particles entering the pneumatic classifier more or less fluctuates, it is possible to perform a smooth operation. This implies that there is no need of a precise control of flow rates and that the set conditions at the initial stage of the run will nearly suffice, almost no adjustment being needed during the operation. The control of particle size can also be achieved by adjusting only the amount of the oxygen-containing gas, with the amount withdrawn being kept always constant.

The position to which the heated particles adjusted in size are returned is preferably a position showing no resistance to the introduction. In this regard the desirable one is beneath the boundary surface of the fluidized bed in the upper part of the coke heater. That is to say, the heated particles that return have reduced size so that it is not preferable to return them to the position above the boundary surface of the fluidized bed, because it is feared that they maybe blown off upon returning. On the other hand, in the lower portion of the fluidized bed the resistance to the introduction of particles is large by virtue of the existing head. When considering these situations collectively it is concluded that the returning to the position just beneath the boundary surface of the fluidized bed is the best.

As described above the process of this invention is a well-established process which can be carried out by the use of an extremely simple and convenient apparatus, and also, which is outstandingly economical in the aspect of the efficient utilization of the heat of combustion of coke, etc.

Now, with reference to FIG. 1, one embodiment of this invention will be explained illustrating one example of a heavy residual oil thermal cracking apparatus in which heavy residual oil as the raw material is subjected to thermal cracking in te coexistence of steam at a temperature of 700° – 850° to form olefins such as ethylene, etc. In thermal cracking reactor 1 and coke heater 2 the coke particles are in the fluidized state by virtue of the steam blown in through nozzles 10 in their lower parts, and the heating source necessary for the thermal cracking is provided by external burner 3. The raw material oil is blown through nozzle 8, and cracked heavy residual oil containing coke fines and coarse particles of comparatively small size is blown through nozzle 9, respectively, into the fluidized bed of reactor 1. The blowing through nozzle 9 is not always required, but the blowing is greatly effective to maintain positively the coke balance. The raw material oil undergoes thermal cracking in reactor 1 to form cracked gas, cracked oil, and coke, which deposits on the surfaces of the coke particles constituting the fluidized bed. The cracked gas and the vapor of the cracked oil are led through pipe 11 to cyclone 4, where the larger part of the coke particles that have passed out of reactor 1 accompanying the effluent are separated, and the separated coke particles are returned through pipe 12 to reactor 1. The cracked gas and the vapor of the cracked oil that contain some of the coarse particles of coke and coke fines are sent through pipe 13 to the subsequent treatment step. The built up coke particles circulate through both vessels, namely reactor 1 and heater 2, and are partially withdrawn through vertical pipe 14 from transport pipe 7, and led to storage vessel 5, into which steam is blown through nozzle 17. The coke particles withdrawn are led through overflow pipe 15 to pneumatic classifier 6, into which steam is blown through nozzle 19, and fine particles are recycled as such through vertical pipe 16 from overflow pipe 15 to coke heater 2. The coarse particles which form a fluidized bed at the lower part of the pneumatic classifier are allowed to burn by blowing air into the bed through nozzle 18. The coke particles whose size has been reduced as a result of combustion are blown up through vertical pipe 16 to coke heater 2 for recycling.

EXAMPLE

The constitution of the apparatus is as shown in FIG. 1, and the inside diameter of the reactor is 600mm, and the inside diameter of the coke heater is 1,040mm. In this apparatus experiments were carried out under the following conditions.

| | | |
|---|---|---|
| Raw material | Khafji Vacuum residue (penetration 80 – 100) | 150kg/Hr |
| Cracked heavy residual | | 10kg/hr |
| Steam used/raw material weight ratio | | 2.5 |
| Reaction temperature | | 750° C |
| Amount of the formed coke adhered on coke particles | | 19.3kg/Hr |
| Amount of the coke lost by gasification of coke particles | | 13.6kg/Hr |
| Amount of the coke lost by | | |

-continued

| | |
|---|---|
| powdering and other causes | 3.1kg/Hr |
| Increase in amount of the coke held within apparatus | 2.6kg/Hr |

Figure 2:
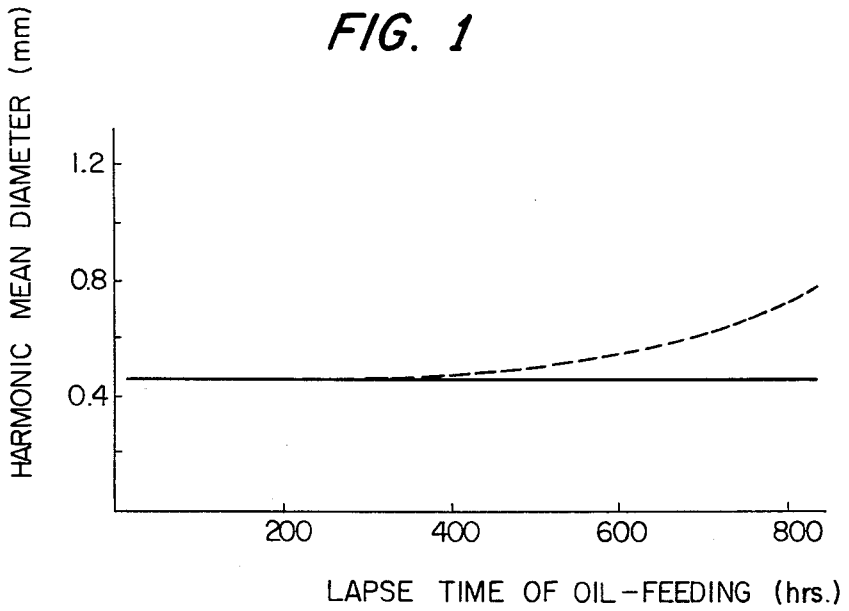
FIG. 2 indicates the variation of the mean particle diameter (harmonic mean diameter) of the coke particles within the fluidized bed versus the lapse time of oil-feeding, and FIG. 3-A and 3-B indicate the particle diameter distribution (cumulative distribution) of the coke within the fluidized bed immediately after the oil-feeding is begun, after 500 hours, and after 800 hours, respectively, with comparison being made between the process of this invention (FIG. 3-B) and the conventional process (FIG. 3-A). In addition, the solid line in FIG. 2 shows the result of the process of this invention, and the broken line shows that of the conventional process.
Figure 3A:
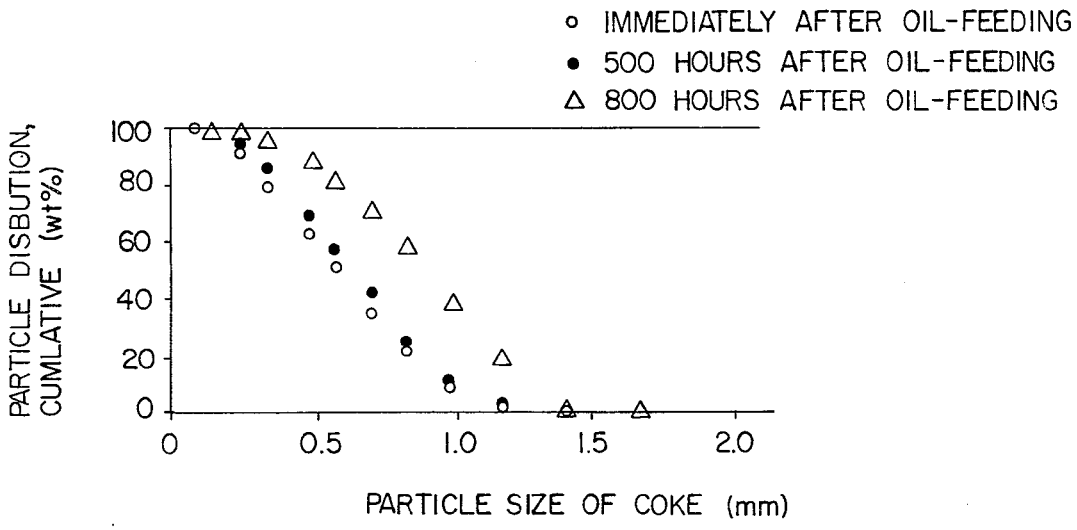
Figure 3B:
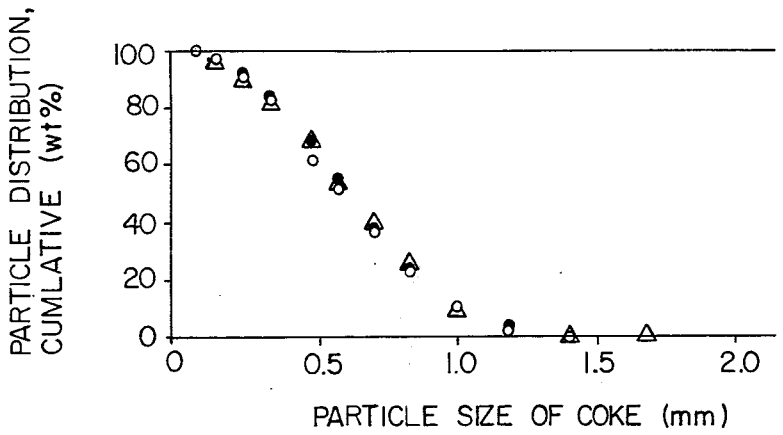

FIGS. 2 and 3-A and 3-B indicate the variation in the size of coke particles in the above described experiments in comparison with that in the conventional process. FIG. 2 is a graph showing the harmonic means diameter within the apparatus versus the lapse time of oil-feeding, and FIG. 3A and 3-B are graphs showing the cumulative distribution of particles within the apparatus at several midway times. In the case of the conventional process it was necessary to withdraw the particles at a rate of about 60kg/day from the bottom of the apparatus. This withdrawing operation was troublesome because of its high temperature, and during the withdrawal instability in operation of the apparatus owing to a decrease of the reactor temperature as well as some slowing down of particle; On the other hand, in the case of the process of this invention, a stable operation could be achieved (without the necessity of withdrawing the particles out of the system) under the following conditions.

| | |
|---|---|
| Diameter of pneumatic classifier | 150mm |
| Height of pneumatic classifier | 2,500mm |
| Amount of particles fed to pneumatic classifier | 100kg/Hr |
| Amount of air blown in for combustion | 22.4 - 25.2Nm$^3$/Hr |
| Amount of steam used for fluidization | 26.3 - 29.7kg/Hr |
| Particle concentration at inlet of pneumatic classifier | 0.36 - 0.39kg/m$^3$ |

What is claimed is:

1. In a process for the thermal cracking of heavy residual oil or crude oil with a fluidized bed of a particulate coke heat carrier in a system comprising a fluidized bed reaction zone for cracking said heavy residual oil or crude oil and a heating zone for heating said particulate coke heat carrier and wherein heavy residual oil or crude oil is thermally cracked at a high temperature by means of a fluidized bed consisting of coke particles and steam under conditions which maintain a positive coke balance in the system such that an amount of coke is formed that is greater than an amount of coke lost during operation of said process; particulate coke from the fluidized bed reaction zone is circulated to said heating zone wherein it is heated and said heated particulate coke heater carrier is returned to said fluidized bed reaction zone; the improvement for controlling the coke balance and the size of the particles of said particulate coke heat carrier in a range adapted for continuous operation comprising: withdrawing a portion of the particulate coke heated in the heating zone from a position intermediate said heating zone and said reaction zone; providing a storage zone for receiving said withdrawn particulate coke, the particles of the particulate coke heat carrier being maintained in a fluidized state in the storage zone by means of a gas introduced thereinto; passing a controlled amount of the withdrawn particulate coke to a pneumatic classifier wherein the particles of the particulate coke are classified into relatively coarse particles and relatively fine particles; contacting the relatively coarse particles with an oxygen-containing gas to cause partial combustion thereof thereby reducing the particle size and, thereafter, returning said sizereduced particles with said relatively fine particles and the flue gas resulting from the combustion of the coarse particles to the heating zone.

2. The process of claim 1 wherein a heavy residual oil is thermally cracked at a temperature of 700° - 850° C.

3. The process of claim 2 wherein the fluidized reaction zone is a fluidized bed reactor and the heating zone is a fluidized bed heater; particulate coke from an upper portion of the fluidized bed reactor is circulated via a first transport pipe to a lower portion of the fluidized bed heater and wherein particulate coke heated in said fluidized bed heater is returned from an upper portion of fluidized bed heater via a second transport pipe to a lower portion of the fluidized bed reactor.

4. The process of claim 3 wherein the storage zone receives the withdrawn portion of heated particulate coke from the second transport pipe.

* * * * *